United States Patent [19]

Faulkner et al.

[11] 4,446,401

[45] May 1, 1984

[54] PHOTOMULTIPLIER TUBE HAVING IMPROVED COUNT-RATE STABILITY

[75] Inventors: Richard D. Faulkner, Lancaster; Daniel L. Thoman, Leola; Arthur F. McDonie, Lancaster, all of Pa.

[73] Assignee: RCA Corporation, New York, N.Y.

[21] Appl. No.: 323,287

[22] Filed: Nov. 20, 1981

[51] Int. Cl.[3] ..... H01J 40/00

[52] U.S. Cl. ..... 313/533; 313/532; 313/541; 313/537

[58] Field of Search ..... 313/528, 530, 532, 533, 313/534, 535, 536, 537, 541

[56] References Cited

U.S. PATENT DOCUMENTS

| | | | |
|---|---|---|---|
| 2,200,722 | 5/1940 | Pierce et al. | 250/175 |
| 2,245,624 | 6/1941 | Teal | 250/175 |
| 2,895,068 | 7/1959 | Rodda | 313/102 |
| 3,183,390 | 5/1965 | Grader et al. | 313/95 |
| 3,873,867 | 3/1975 | Girvin | 313/95 |
| 4,184,098 | 1/1980 | Morales | 313/95 |
| 4,370,585 | 1/1983 | Butterwick | 313/536 |

*Primary Examiner*—David K. Moore
*Assistant Examiner*—K. Wieder
*Attorney, Agent, or Firm*—Eugene M. Whitacre; Dennis H. Irlbeck; Vincent J. Coughlin, Jr.

[57] ABSTRACT

A photomultiplier tube includes an evacuated envelope having therein a photocathode, an anode and an electron multiplier disposed between the cathode and the anode for propagating and concatenating electrons along a path therebetween. The electron multiplier and the anode are supported by a pair of oppositely-disposed support plates. At least one aperture which extends along at least a portion of the electron path is formed in each plate. A pair of focusing shields may be spaced from the exterior surface of each of the support plates. The focusing shields are disposed adjacent to the apertures in the support plates and extend longitudinally along the electron path to provide a transverse focusing field which prevents substantially all of the electrons from impinging on the interior surface of the support plates.

4 Claims, 3 Drawing Figures

PHOTOMULTIPLIER TUBE HAVING IMPROVED COUNT-RATE STABILITY

BACKGROUND OF THE INVENTION

The invention relates to photomultiplier tubes and particularly to a structure for improving the count-rate stability and for reducing the dark current of such tubes.

In certain photomultiplier tube applications, operational instability may occur when the anode current level abruptly changes due to changes in the input signal. In such instances, it has been noted that a conductive pattern, such as that disclosed in U.S. Pat. No. 3,873,867, issued to Girvin on Mar. 25, 1975, may be used to focus the electrons so that they will not impinge upon the insulating support spacers which hold the dynodes of the tube. The conductive pattern is intended to prevent the support spacers from charging under electron bombardment. By reducing the charging of the spacers, the operational instability condition, commonly known as "hysteresis", is prevented. The Girvin patent suggests that a conductive coating consisting of molybdenum material applied by a silk-screening technique may be deposited on the ceramic spacer. Alternatively, it is also known that other materials such as aluminum or nickel may also be used. The conductive pattern is generally tied to the same potential as the first dynode; however, other potentials between first dynode potential and anode potential may also be used.

The aforementioned conductive coating generally has a resistance in the neighborhood of a few ohms per square and typically a conductive pattern having a resistance of one ohm per square is produced by the silk-screening process. Tubes having the aforedescribed conductive pattern, which is fixed at or near the potential of the first dynode, are prone to exhibit excessive dark current when operated near the maximum operating voltage. This phenomenon is believed due to the fact that the conductive pattern, which extends along the electron path from the first dynode to the anode, creates a high electric field in the neighborhood of the last dynode adjacent to the anode. The electric field causes luminescence in the ceramic which feeds light back to the photocathode to increase the dark current by generating a spurious input signal. In an attempt to reduce the light feedback to the photocathode, a number of photomultiplier tubes having silk-screened conductive nickel coatings disposed on chrome oxide-coated support spacers have been evaluated. The chrome oxide, it has been found, quenches some of the electric field induced luminescence; however, the amount of light fed back to the photocathode is still sufficient to create excessive dark current within the tube. As a consequence, it is necessary to bake the photomultiplier tube at an elevated temperature in order to reduce the dark current. The baking process has an undesirable side effect in that it tends to reduce the cathode sensitivity of the tube and degrade the pulse-height resolution of the tube while reducing the dark current.

An improved photomultiplier tube structure is disclosed in copending U.S. patent application, Ser. No. 172,659 filed on July 28, 1980 by McDonie et al. and entitled, "PHOTOMULTIPLIER TUBE HAVING A HIGH RESISTANCE DYNODE SUPPORT SPACER ANTI-HYSTERESIS PATTERN", assigned to the assignee of the present invention and incorporated herein for the purpose of disclosure. The McDonie et al. structure comprises a chrome oxide layer having a resistance ranging from about $10^{12}$ ohms per square to about $10^{15}$ ohms per square on the support spacers with a high resistance Nichrome coating having a resistance greater than about $10^{6}$ ohms per square to less than about $10^{12}$ ohms per square overlying the chrome oxide layer along the electron path. The structure of McDonie et al. eliminates the problem of luminescence in the ceramic spacer by permitting a voltage drop to occur across the high impedance Nichrome coating thereby preventing high currents across the support spacer.

The McDonie et al. structure operates well at room temperature; however, at elevated operating temperatures of about 54° C., an increase in ohmic leakage occurs which does not decrease when the tube is cooled to room temperature. The ohmic leakage appears to be imprinted on the McDonie et al. structure and acts to load down the high voltage power supply of the photomultiplier tube. In addition to the ohmic leakage problem, the McDonie et al. structure exhibits poor count-rate stability. Count-rate stability is related to the above-described hysteresis effect and is defined as the variation in pulse height for a change in the pulse-count rate. To measure count-rate stability, a photomultiplier tube with a crystal scintillator affixed to the input face-plate is exposed to a radioactive source. The output of the photomultiplier tube is monitored to determine the counting rate of the tube. The radioactive source is positioned at a distance from the scintillator to produce 10,000 counts per second from the photomultiplier tube. The tube output is recorded on a multichannel analyzer and the position of the photopeak at 10,000 counts per second is compared to the photopeak position at a counting rate of 1,000 counts per second. The count-rate stability is expressed as the percentage shift in photopeak position for the count-rate change. A photomultiplier tube designed for counting stability may be expected to have a shift of not more than one percent as measured by the above-described count-rate stability measurement.

It is thus desirable to eliminate the cause of dynode support spacer hysteresis that causes high dark current and count-rate instability in photomultiplier tubes.

SUMMARY OF THE INVENTION

A photomultiplier tube comprises an evacuated envelope having therein a photoemissive cathode, an anode, an electron multiplier disposed between the cathode and the anode for propagating and concatenating electrons along a path therebetween, and a pair of oppositely-disposed insulative support plates for supporting the electron multiplier and the anode. At least one aperture is formed in each of the support plates. The apertures extend along at least a portion of the electron path.

DESCRIPTION OF THE PREFERRED EMBODIMENT

Figure 1:
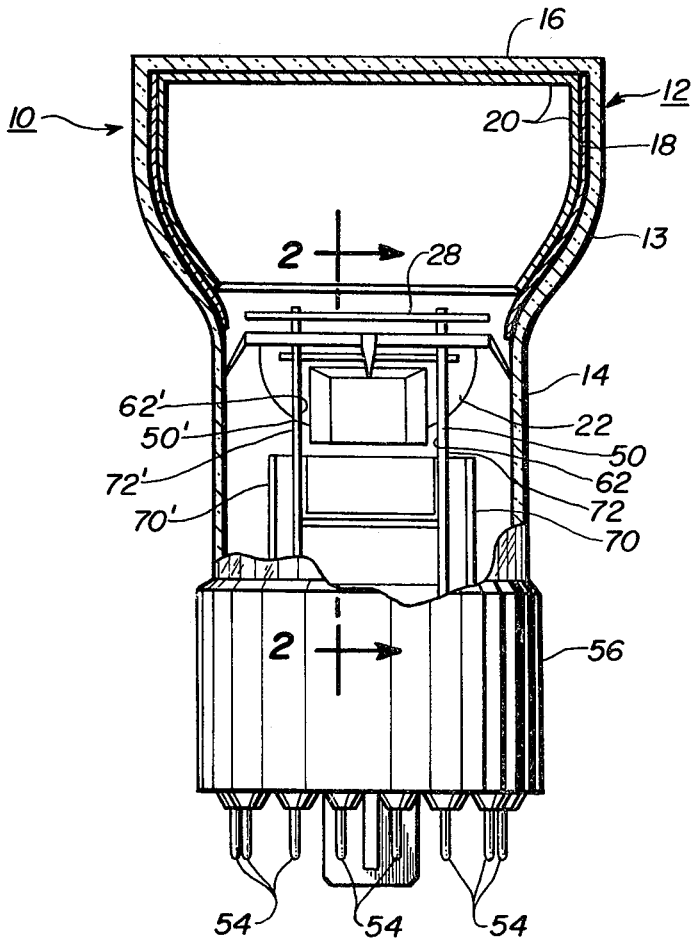
FIG. 1 is a partially cut-away side view of a photomultiplier tube made in accordance with the present invention.
Figure 2:
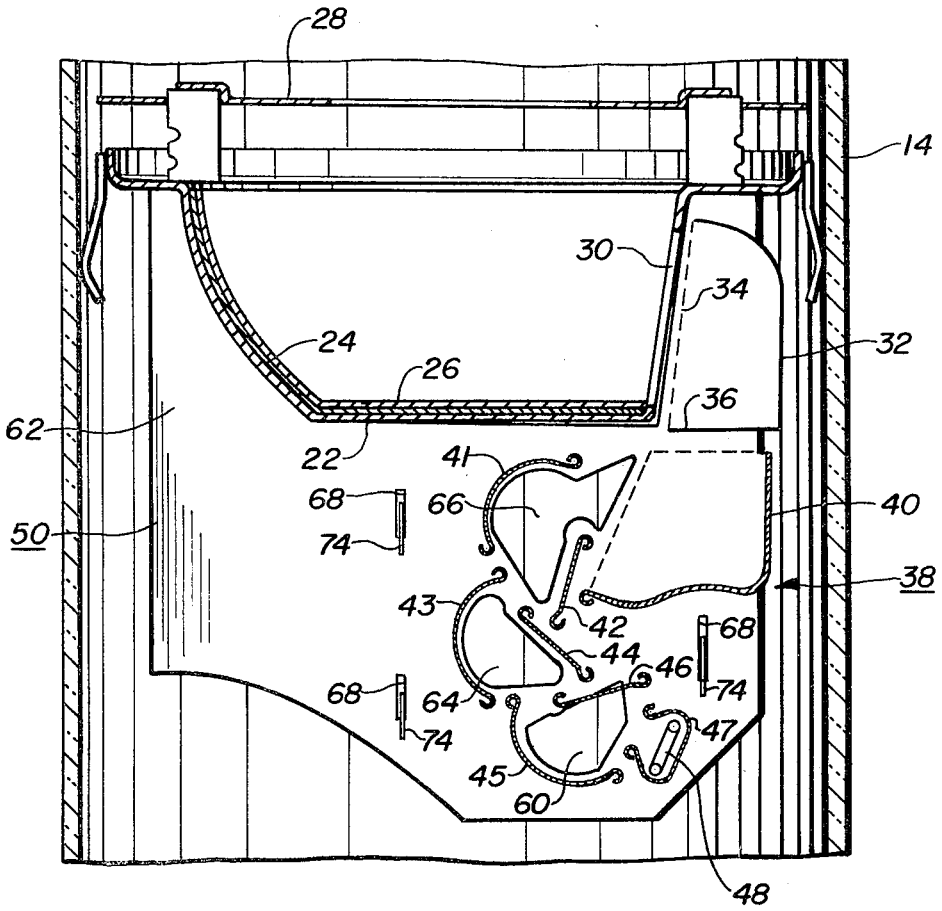
FIG. 2 is a partial cross-sectional view of the electron multiplier depicted in FIG. 1 showing one of the novel support plates.

Referring to FIGS. 1 and 2, there is shown a photomultiplier tube 10 comprising an evacuated envelope 12 including a funnel portion 13 having a small end which is joined to a generally cylindrical neck portion 14 and a large end which is sealed to a faceplate 16 that closes one end of the envelope. An aluminized coating 18 is disposed on a portion of the sidewall adjacent to the faceplate 16. Within the tube 10 is a photoemissive cathode, hereinafter called a photocathode 20 on the faceplate 16 and also along a portion of the aluminum coating 18 on the sidewall adjacent to the faceplate. The photocathode 20 may be potassium-cesium-antimonide, for example, or any one of a number of photoemissive materials well known in the art. Inside the tube 10 is a primary or first teacup dynode 22, preferably of a beryllium-copper material, having an active oxide secondary emissive surface 24 such as beryllium oxide, for example, which faces the faceplate 16. A substantially uniform layer 26 of alkali antimonide compound, such as potassium-cesium-antimonide, may overlie the coating 24 as disclosed in copending U.S. patent application, Ser. No. 132,659, filed on Mar. 21, 1980 by Faulkner et al. now U.S. Pat. No. 4,311,939 assigned to the same assignee as the present invention and incorporated by reference herein for the purpose of disclosure. An apertured focusing electrode 28 is disposed in spaced relation between the teacup dynode 22 and the photocathode 20 on the faceplate 16. The teacup dynode 22, as described in the Faulkner et al. copending patent application, has an output aperture 30 adjacent to a second dynode 32.

The second dynode 32, preferably made from beryllium-copper, acts as a receiving member for secondary electrons emitted from the teacup dynode 22. The second dynode 32 has an input aperture 34 and an output aperture 36. Secondary electrons emitted from the beryllium oxide secondary emissive surface (not shown) of the second dynode 32, pass through the output aperture 36 and serve as primary electrons which impinge upon a chain or array 38 of eight beryllium-copper dynodes, consecutively numbered 40 through 47 inclusive, and an anode 48. The anode 48 is partially surrounded by an anode shield or ultimate dynode 47 of the array 38. Each of the dynodes 40 through 47 have a beryllium oxide secondary emissive surface (not shown).

While a total of ten dynodes may be utilized in the above-described embodiment for propagating and contatenating electron emission from the photocathode 20 to the anode 48, it is clear to one skilled in the art that additional dynodes may either be included between the second dynode 32 and the anode 48 or dynodes may be eliminated from the array. The total number of dynodes is governed, among other things, by the final gain desired from the tube.

The dynodes 22, 32, and 40 through 47 are supported by a pair of insulating support spacers or plates 50 and 50'. The support plates 50 and 50' are identical to each other and may be made by any insulating material, although a material such as Fotoceram is preferred. Fotoceram is manufactured by Corning Glass Company, Corning, N.Y.

Evaporator assemblies (not shown) are provided to activate the secondary emissive surface of the dynodes and to form the photocathode 20. Such evaporators are described, for example, in the above-mentioned Faulkner et al. copending patent application.

The dynodes 22, 32, and 40 through 47, the focusing electrode 28, the photocathode 20 and the anode 48 have conductive wires attached thereto for placing electrostatic charges thereon. The wires (not shown) terminate at a plurality of pins 54 located in a base 56 attached to the tube 10. As so far described, the photomultiplier tube 10 having a teacup primary dynode is known, per se, in the prior art.

As shown in FIG. 2, the support plate 50 includes at least one aperture 60 which substantially conforms to the shape of the interelectrode region along the electron path extending from the secondary dynode 45 to the penultimate dynode 46, and partially along the electron path extending from the penultimate dynode 46 to the ultimate dynode 47. A similar aperture is formed in the support plate 50'. By providing apertures in that portion of the insulating support plates 50 and 50' along the electron beam path where divergent secondary electrons are likely to strike the interior surfaces 62 and 62' of the support plates 50 and 50', respectively, and cause electrostatic charging, the dark current and count-rate stability of the tube are improved. In the preferred embodiment of FIG. 2, additional apertures 64 and 66 are provided along the electron beam path to further minimize the surface area of the support plate 50. Corresponding apertures are provided in the support plate 50'.

Between the third dynode 40 and the ultimate dynode 47, only enough material of the spacers 50 and 50' remains to provide support for the intermediate dynodes 41–46. A plurality of slit-like attachment slots 68 are formed in support plates 50 and 50', respectively, for a purpose to be disclosed hereinafter.

In order to minimize the loss of signal caused by secondary electron exiting from the multiplier array 38 through the apertures in the support spacers 50 and 50', a pair of external focusing shields 70 and 70' are spaced from the exterior surfaces 72 and 72' of each of the support plates 50 and 50', respectively. The focusing shields 72 and 72' are substantially rectangularly-shaped channel-like members formed from nonmagnetic stainless steel. Each of the shields has a plurality of locking tabs 74 for attaching the shields 72 and 72' to the slots 68 in the support plates 50 and 50'. The focusing shields 72 and 72' are operated at a potential that is negative with respect to the potential applied to dynodes 40–47 so that a transverse electrostatic focusing field acts through the apertures formed in the support spacers 50 and 50' to focus substantially all of the secondary electron beams inwardly away from the interior surfaces 62 and 62' of the support spacers.

Figure 3:
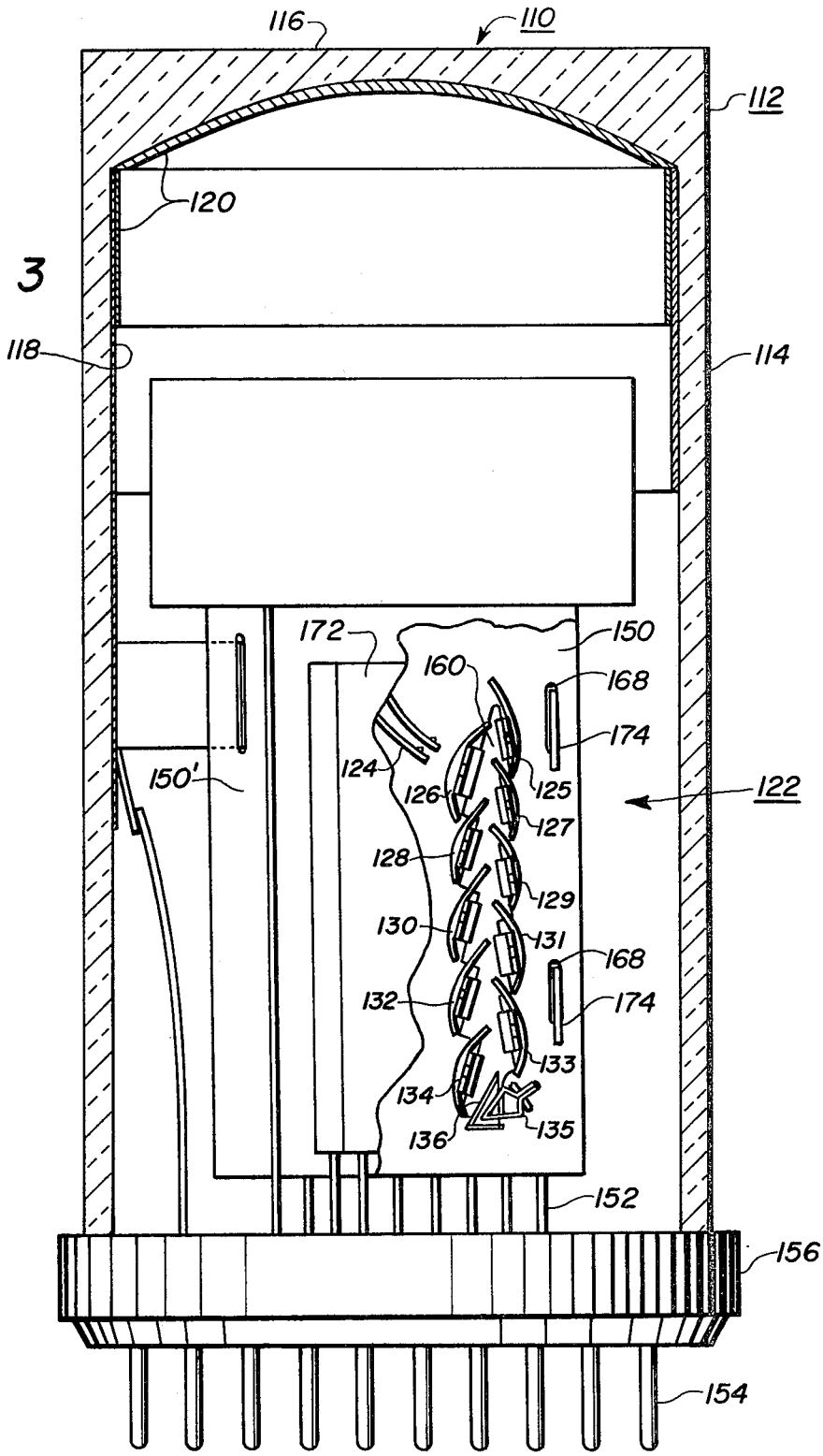
FIG. 3 is a partially cut-away side view of another type of photomultiplier tube made in accordance with the present invention.

A second embodiment of the present novel support plate structure is shown in FIG. 3. The photomultiplier tube 110 is disclosed in U.S. patent application, Ser. No. 311,279, filed on Oct. 14, 1981. The Faulkner et al. copending patent application is assigned to the same assignee as the present invention and is incorporated by reference herein for the purpose of disclosure.

The photomultiplier tube 110 is similar to the photomultiplier tube 10 described above and comprises an evacuated envelope 112 with a generally cylindrical sidewall 114 and a faceplate 116. An aluminized coating 118 is disposed on a portion of the sidewall 114 adjacent to the faceplate 116. A photocathode 120 of an alkali antimonide compound, such as potassium-cesium-antimonide, is formed on the faceplate 116 and on a portion of the aluminized coating 118 on the sidewall 114.

An electron multiplier 122 comprises an arcuately-shaped primary dynode 124, a plurality of secondary dynodes consecutively numbered 125 through 135, and an anode 136. The dynodes 124 and 125 through 135 may be formed of a beryllium-copper alloy or other suitable material well known in the art. The secondary dynodes 125 through 135 and the anode 136 are laterally displaced from the primary dynode 124 and are attached between a pair of support plates 150 and 150'. The support plates 150 and 150' are identical to each other and are preferably formed of Fotoceram or another insulating material.

Evaporator assemblies (not shown) are provided to activate the secondary emissive surface of the dynodes and to form the photocathode. The dynodes 124, 125–135, and the other tube electrodes have conductive wires 152 attached thereto for placing electrostatic charges thereon. The magnitude of the charges is disclosed in the above-referenced copending Faulkner et al. application. The wires terminate at a plurality of metal pins 154 located in a base 156 attached to the tube 110.

As shown in FIG. 3, the support plate 150 includes an aperture 160 which extends from the secondary dynode 125 along the array of secondary dynodes to the ultimate dynode 135. The aperture 160 substantially conforms to the shape of the interelectrode region along the electron path from the secondary dynode 125 to the ultimate dynode 135. A similar aperture is formed in the support plate 150'. The aperture 160 in each support plate removes insulating material from along the electron beam path extending from dynode 125 to dynode 135. Thus, dark current and count-rate instability caused by the electrostatic charging of the interior surfaces of the support plates by divergent secondary electrons striking the plates is reduced. A plurality of slit-like attachment slots 168 are formed in the support plates 150 and 150' for a purpose to be disclosed hereinafter.

A pair of focusing shields 172 (only one is shown) are disposed along the exterior surface of the support plates 150 and 150' to provide a transverse electrostatic focusing field to prevent the secondary electrons produced by the secondary dynodes 125 through 135 from exiting from the multiplier array through the aperture 160 in the support plates 150 and 150'. The focusing shields 172 are preferably operated at a potential that is negative with respect to the potentials on dynodes 126 through 135 to focus the secondary electrons inwardly, away from the interior surfaces of the support spacers 150 and 150'. The shields 172 are formed by bending thin strips of nonmagnetic stainless steel to form a substantially rectangular channel. A plurality of locking tabs 174 are formed in the longitudinal edges of the shield 172. The tabs 174 are inserted into the slots 168 in the support plates 150 and 150'.

What is claimed is:

1. In a photomultiplier tube comprising an evacuated envelope, a photoemissive cathode within said envelope, an anode spaced from said photoemissive cathode, an electron multiplier disposed between said cathode and said anode for propagating and concatenating electrons along a path therebetween, and a pair of oppositely-disposed insulating support plates for supporting said electron multiplier and said anode, the improvement wherein said support plates include at least one aperture formed in each of said support plates, said aperture extending along at least a portion of said electron path, and focusing means contiguous with each of said support plates for providing a transverse electrostatic focusing field acting through said aperture to focus substantially all of said concatenating electrons inwardly away from said support plates.

2. In a photomultiplier tube comprising an evacuated envelope, a photoemissive cathode within said envelope, an anode spaced from said photoemissive cathode, an electron multiplier disposed between said cathode and said anode for propagating and concatenating electrons along a path therebetween, and a pair of oppositely-disposed insulating support plates for supporting said electron multiplier and said anode, said plates having an interior and an exterior surface, the improvement wherein said support plates include at least one aperture formed in each of said support plates, said aperture extending along at least a portion of said electron path, and focusing means spaced from said exterior surface of each of said plates, said focusing means being disposed adjacent to said aperture in each of said plates, said focusing means extending longitudinally along said electron path for providing a transverse electrostatic focusing field to prevent substantially all of said electrons from impinging upon said interior surface of each of said support plates.

3. In a photomultiplier tube comprising an evacuated envelope, a photoemissive cathode within said envelope, an anode spaced from said photoemissive cathode, a plurality of dynodes disposed between said cathode and said anode for propagating and concatenating electrons along a path between said cathode and said anode, and a pair of oppositely-disposed insulating support plates for supporting said dynodes and said anode, the improvement wherein said support plates include at least one aperture formed in each of said support plates, said aperture substantially conforming to the shape of the interelectrode region between said dynodes extending along said electron path, and focusing means contiguous with each of said support plates for providing a transverse electrostatic focusing field acting through said aperture to focus substantially all of said concatenating electrons inwardly away from said support plates.

4. In a photomultiplier tube comprising an evacuated envelope, a photoemissive cathode within said envelope, an anode spaced from said photoemissive cathode, a plurality of dynodes disposed between said cathode and said anode for propagating and concatenating electrons along a path between said cathode and said anode, said dynodes comprising a primary dynode, a secondary dynode, a penultimate dynode and an ultimate dynode, and a pair of oppositely-disposed insulating support plates for supporting said dynodes and said anode, said plates having an interior and an exterior surface, the improvement wherein said support plates include at least one aperture formed in each of said support plates, said aperture substantially conforming to the shape of the interelectrode region along the electron path extending from said secondary dynode to said penultimate dynode and at least partially along said path extending from said penultimate dynode to said ultimate dynode, and focusing means spaced from said exterior surface of each of said support plates, said focusing means being disposed adjacent to said aperture in each of said plates, said focusing means extending longitudinally along said electron path for providing a transverse electrostatic focusing field to prevent substantially all of said electrons from impinging upon said interior surface of each of said support plates.

* * * * *